US007287768B2

(12) United States Patent
Myers et al.

(10) Patent No.: US 7,287,768 B2
(45) Date of Patent: Oct. 30, 2007

(54) MULTI-MODE CHILD ENTERTAINING APPARATUS AND METHODS OF USING THE SAME

(75) Inventors: Peter J. Myers, Wheaton, IL (US); Damon Oliver Casati Troutman, Lake Forest, IL (US)

(73) Assignee: Kolcraft Enterprises, Chicago, IL (US)

( * ) Notice: Subject to any disclaimer, the term of this patent is extended or adjusted under 35 U.S.C. 154(b) by 114 days.

(21) Appl. No.: 10/748,804

(22) Filed: Dec. 30, 2003

(65) Prior Publication Data

US 2005/0146106 A1 Jul. 7, 2005

(51) Int. Cl.
*B62B 7/00* (2006.01)

(52) U.S. Cl. ..... 280/87.051; 280/87.05; 280/649

(58) Field of Classification Search ..... 280/87.051, 280/43.24, 87.03, 200, 647, 650, 658, 87.041, 280/649; 472/15, 135, 103; 282/77, 66; 297/137, 258.1, 271.5
See application file for complete search history.

(56) References Cited

U.S. PATENT DOCUMENTS

| | | | | |
|---|---|---|---|---|
| 8,478 | A | | 10/1851 | Rice |
| 11,140 | A | | 6/1854 | Burkholder |
| 149,178 | A | | 3/1874 | Wright |
| 432,378 | A | | 7/1890 | Davidson et al. |
| 517,403 | A | | 3/1894 | Bradish et al. |
| 671,058 | A | | 4/1901 | Resetar |
| 1,141,123 | A | | 6/1915 | Knight |
| 1,428,039 | A | | 9/1922 | Kratz |
| 1,448,783 | A | * | 3/1923 | Blewitt et al. ..... 297/6 |
| 1,656,637 | A | | 1/1928 | Hudson |
| 2,198,813 | A | | 4/1940 | Hall |
| 2,282,086 | A | | 5/1942 | Peltier |
| 2,312,602 | A | | 3/1943 | Taylor |
| 2,697,478 | A | | 12/1954 | McKinney |
| 2,709,079 | A | | 5/1955 | Bubb et al. |
| 2,765,839 | A | | 10/1956 | Arpin |
| 2,812,012 | A | | 11/1957 | Hansburg |
| 2,910,111 | A | | 10/1959 | Hansburg |
| 2,978,245 | A | | 4/1961 | Rempel |
| 2,988,358 | A | | 6/1961 | Mills |
| 3,009,733 | A | | 11/1961 | Gelman |
| 3,145,048 | A | | 8/1964 | Etal |
| 3,235,254 | A | | 2/1966 | Robson |
| 3,337,230 | A | | 8/1967 | Golding |

(Continued)

FOREIGN PATENT DOCUMENTS

EP 0 275 497 7/1988

OTHER PUBLICATIONS

*Entertainer Activity Center*®, Graco Owner's Manual, pp. 1-11 (2001).
Model No. 4654, Graco Owner's Manual, pp. 1-32 (2002).

*Primary Examiner*—Hau Phan
(74) *Attorney, Agent, or Firm*—Hanley, Flight & Zimmerman, LLC

(57) ABSTRACT

Multi-mode child entertaining apparatus and methods of using the same are disclosed. A disclosed apparatus may be configured as a walker alternative which includes a base, a seat, and a wheeled walker to at least partially support the seat above the base. The wheeled walker is removable from the base for use apart from the remainder of the apparatus.

30 Claims, 12 Drawing Sheets

U.S. PATENT DOCUMENTS 3,494,613 A 2/1970 Hatfield
3,692,359 A 9/1972 Boucher
3,796,430 A * 3/1974 Sudo ..... 280/87.05
4,025,107 A 5/1977 Chippa
4,045,045 A 8/1977 Boucher et al.
4,084,273 A 4/1978 Haynes
4,141,588 A 2/1979 Anderson
4,160,553 A 7/1979 Fleischer
4,165,127 A 8/1979 Vago
4,171,847 A 10/1979 Tukui
4,231,582 A 11/1980 Moss
4,261,588 A 4/1981 Kassai
4,359,242 A 11/1982 Gerken et al.
4,364,576 A 12/1982 Kassai
4,480,846 A * 11/1984 Sanchez ..... 280/87.041
D295,397 S 4/1988 Brownlie et al.
4,743,008 A 5/1988 Fermaglich et al.
4,773,639 A 9/1988 Graves
4,795,151 A * 1/1989 Mulcaster ..... 482/68
4,799,700 A 1/1989 Knoedler et al.
4,822,030 A 4/1989 Cone
4,830,345 A 5/1989 Mar
4,844,209 A 7/1989 Sedlack
D315,644 S 3/1991 White
5,013,032 A 5/1991 Baum et al.
5,050,862 A 9/1991 Saghafi
5,054,851 A 10/1991 Chiu
5,071,149 A * 12/1991 Perego ..... 280/87.051
5,080,383 A 1/1992 Hsieh
5,083,806 A 1/1992 Brown
5,085,428 A 2/1992 Fermaglich et al.
D327,777 S 7/1992 Tepper
D332,529 S 1/1993 Shuler
5,178,438 A 1/1993 Beger
5,211,607 A 5/1993 Fermaglish et al.
5,302,163 A 4/1994 Fermaglich et al.
5,320,122 A 6/1994 Jacobson, II et al.
5,366,231 A 11/1994 Hung
5,407,246 A 4/1995 Meeker et al.
5,415,590 A 5/1995 Steingraber et al.
5,433,682 A 7/1995 Fermaglich et al.
5,441,289 A 8/1995 Spielberger
5,462,300 A * 10/1995 Chien ..... 280/87.051
5,474,483 A 12/1995 Sun
5,590,892 A * 1/1997 Hu ..... 280/87.051
5,662,344 A 9/1997 Lu
5,688,211 A 11/1997 Myers
5,700,201 A 12/1997 Bellows et al.
5,704,576 A 1/1998 Meeker et al.
5,722,503 A * 3/1998 Haller ..... 280/87.051
5,727,800 A * 3/1998 Liu ..... 280/87.051
5,728,030 A * 3/1998 Hsieh ..... 482/66
5,788,253 A 8/1998 Thomson et al.
5,813,681 A 9/1998 Saint et al.
5,813,720 A 9/1998 Huang
5,888,178 A 3/1999 Welsh, Jr.
5,934,747 A 8/1999 Garland
6,012,731 A * 1/2000 Liu ..... 280/87.051
6,048,290 A 4/2000 Chen et al.
6,155,902 A 12/2000 Kole, Jr. et al.
6,179,376 B1 1/2001 Meeker et al.
6,206,384 B1 3/2001 Chi et al.
6,231,056 B1 5/2001 Wu
D443,233 S 6/2001 Gaudet et al.
D445,143 S 7/2001 Bellows
6,296,268 B1 10/2001 Ford et al.
6,299,247 B1 * 10/2001 Meeker et al. ..... 297/137
6,386,563 B1 * 5/2002 Chen et al. ..... 280/87.051
D465,440 S 11/2002 Ventrola et al.
2003/0222421 A1 12/2003 Myers et al.

* cited by examiner

MULTI-MODE CHILD ENTERTAINING APPARATUS AND METHODS OF USING THE SAME

FIELD OF THE DISCLOSURE

This disclosure relates generally to child care products, and, more particularly, to multi-mode child entertaining apparatus and methods of using the same.

BACKGROUND

Walkers have been used for years to assist in teaching children to walk. As used herein, the term "walker" is intended to encompass wheeled structures that may be propelled by a child learning to walk. Thus, as used in this document, a walker can be (1) a traditional walker including a wheeled frame which suspends a child in a seat or sling with their feet touching the floor, and/or (2) a walk-behind product which includes a wheeled frame that may be used for support by a standing/walking child but generally does not include a seat/sling to suspend the child. Because traditional walkers suspended the child within a seat/sling, they can be used with a child that is unable to stand. Walk-behind products, on the other hand, do not suspend the child in a seat or sling and, thus, are generally not usable by children who cannot yet stand.

In recent years, walker alternatives have been developed. Walker alternatives (sometimes referred to as activity centers or child entertaining apparatus) generally include a base and a seat/sling that is suspended from a tray above the base. The tray is typically spaced a sufficient distance above the base such that the feet of a child seated in the seat/sling can reach the base to simulate standing. In some known walker alternatives, the tray is suspended above the base using adjustable columns to permit adjustment of the distance between the tray and the base to fit the height of the child.

The seats/slings of the known walker alternatives are typically rotatably suspended in the center of their trays such that the seats/slings are surrounded on all sides by their corresponding trays. Toys can be placed at various positions on the tray to encourage a child suspended in the seat/sling to use his/her legs to rotate themselves to reach the toys of interest. The bases of some known walker alternatives are cupped or bowled (e.g., semi-spherical) to permit rocking of the walker alternative. Some walker alternatives also suspend their trays, and, thus, their seats, using springs to permit bouncing of the tray, seat and/or child.

Walker alternatives have several advantages. For example, because they do not include wheels, a child using the walker alternative is able to exercise their legs without being able to move around the room. However, when children approach the walking milestone, they often desire to move around and, thus, may no longer wish to be placed in the restrictive confines of a walker alternative.

DETAILED DESCRIPTION

Figure 1:
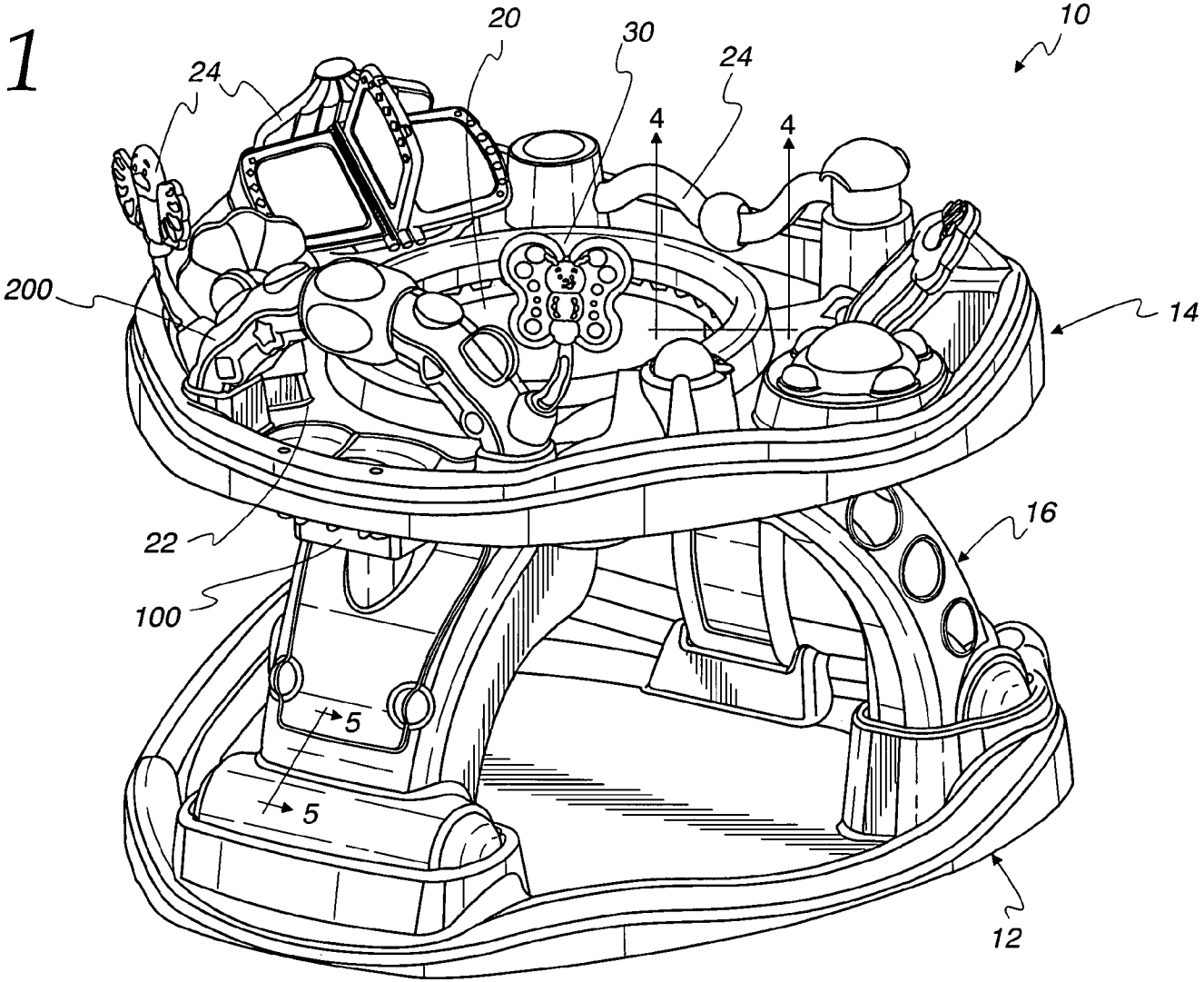
FIG. 1 is a perspective view of an example child entertaining apparatus that may be configured as a walker alternative, a walk behind walker and/or a floor toy activity center.
Figure 2:
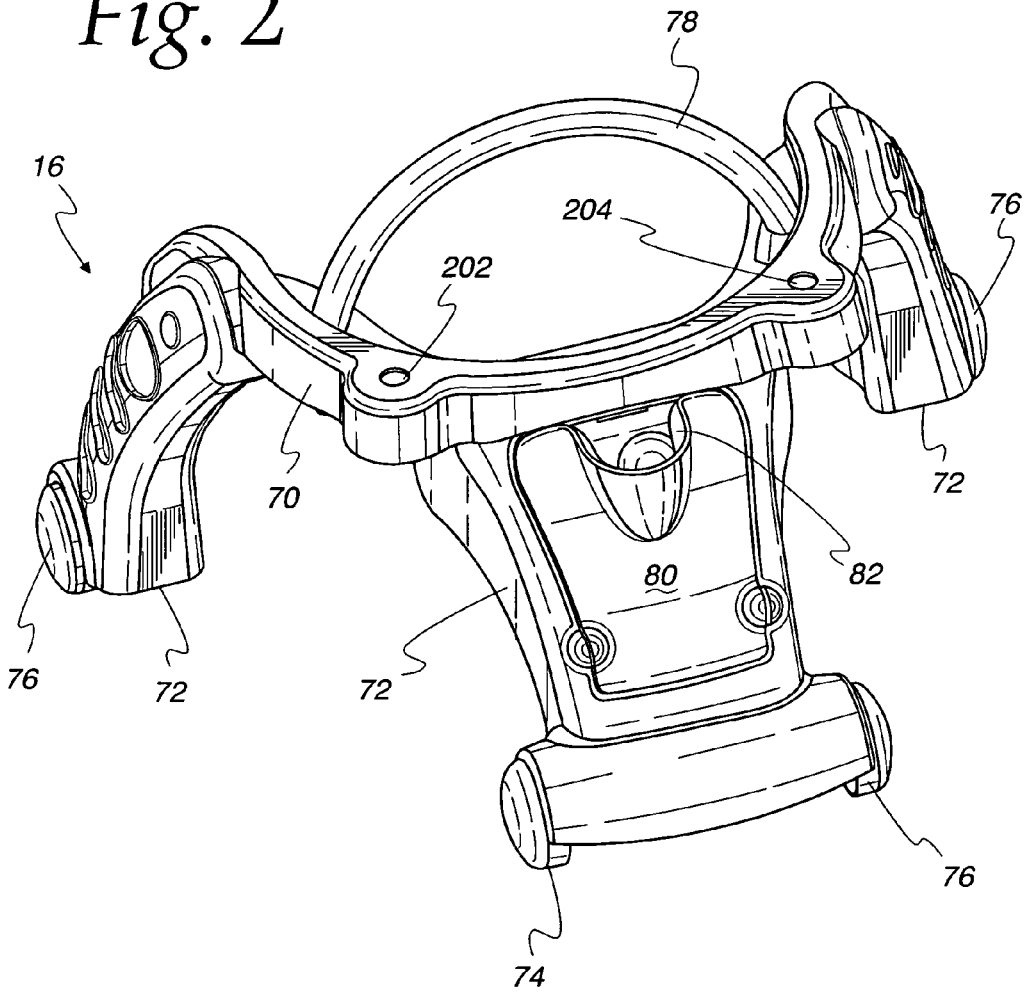
FIG. 2 is a perspective view of the wheeled walker of FIG. 1, shown separated from the remainder of the apparatus.
Figure 3:
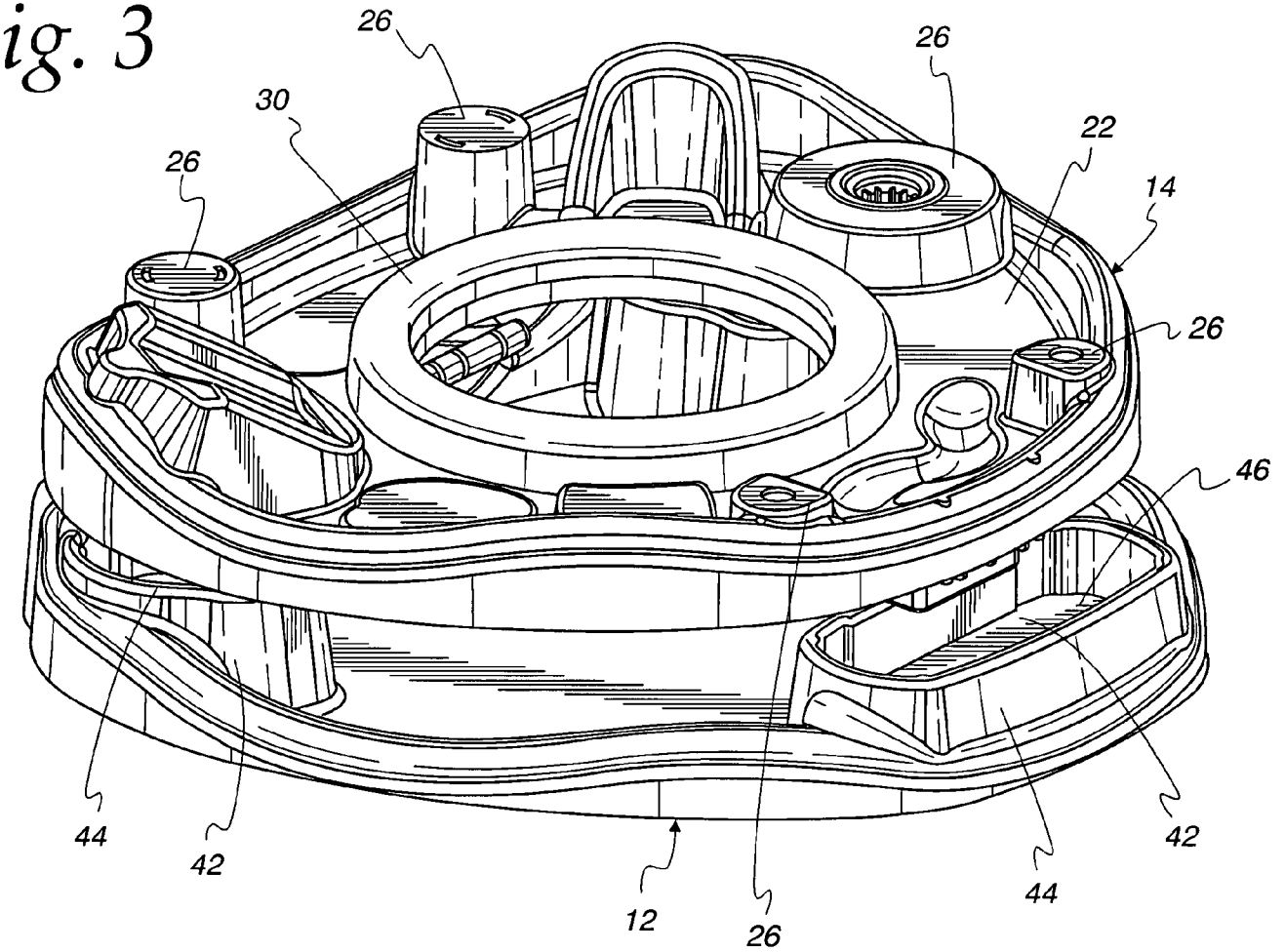
FIG. 3 is a view similar to FIG. 1, but showing the apparatus configured as a floor toy activity center.

FIG. 1 is a perspective view of an example child entertaining apparatus 10 which may be used as a walker alternative, a walk behind walker, and/or a floor toy activity center. The illustrated child entertaining apparatus 10 includes three primary components, namely, a base 12, a tray 14 and a support 16 which supports the tray 14 a distance above the base. When the components of the apparatus 10 are configured as shown in FIG. 1, the apparatus 10 may be used as a walker alternative. In the illustrated example, the support 16 is implemented by a wheeled walker 16. As shown in FIG. 2, the wheeled walker 16 can be removed from the base 12 and the tray 14. When so removed, the wheeled walker 16 may be used as a walk behind walker. Additionally, when the wheeled walker 16 is separated from the remainder of the apparatus 10, the tray 14 may be positioned on top of the base 12 as shown in FIG. 3 such that a child seated on the floor adjacent the base 12 may access the tray 14 and toys disposed thereon. In this configuration, the apparatus 10 functions as a floor toy activity center.

For the purpose of providing rocking motion when the apparatus 10 is used as a walker alternative, the base 12 is domed (i.e., semi-spherical). The domed base 12 is oriented such that a child using the walker alternative 10 stands within the dome and the curved bottom surface of the domed base 12 can rock upon a supporting surface such as a floor. Although using a domed or otherwise curved base is presently preferred, persons of ordinary skill in the art will readily appreciate that alternative base structures may alternatively be employed. For example, the base 12 may have a flat bottom if, for instance, rocking is not desired. As alternative examples, the bottom could have single direction rails for single direction rocking, or an open bottom to permit the child's feet to touch the floor.

If desired, the base 12 may be provided with a rocking lock out mechanism to selectively prevent the base 12 from rocking. Such a lock out mechanism may be implemented, for example, by legs which are pivotably mounted to the bottom of the base 12. In the example illustrated in FIG. 17, a lock out mechanism is provided wherein legs are pivotably mounted under the outer edge of the base 12. The edge of the base 12 is provided with a plurality of windows or opening 300, each of which exposes a portion of a corresponding leg. One or more messages such as "locked," "unlocked," "rocking" or "steady" carried by each of the legs are positioned to be viewed through the window when the leg is in a position corresponding to the message. For example, when the leg is in the retracted position shown in FIG. 17, a message such as "rocking" or "rockable" may appear through the window 300 to indicate that the lock out mechanism is not presently securing the base 12 against rocking. As another example, when the leg is placed in the locked position, a message such as "locked" or "steady" may appear in the window 300 to indicate that the lock out mechanism is securing the base 12 against rocking. To this end, the messages should be positioned on appropriate locations on the legs to ensure the desired message corresponding to the correct state of the lock out mechanism is correctly positioned in the window 300.

The outer perimeters of the base 12 and the tray 14 are preferably of substantially the same size. However, persons of ordinary skill in the art will appreciate that the base 12 and tray 14 may have perimeters of different size. Similarly, although in the illustrated example the outer perimeters of the base 12 and tray 14 have non-circular shapes, persons of ordinary skill in the art will readily appreciate that a base and tray having outer perimeters of other shapes may alternatively be used.

The tray 14 of the illustrated example defines a central aperture 20 such that the tray 14 forms an annular support surface 22. One or more toys 24 may be positioned upon, secured to, or otherwise supported by the tray 14. To this end, the annular support surface 22 may be provided with mounts 26 which are intended to support predetermined toys 24 (see FIG. 3) in a conventional manner. For example, the mounts 26 and toys 24 may be designed to be snap fit together, to permit rotation of the toy 24, and/or to create sound via a mechanical or electronic sound generating device when the corresponding toy 24 is moved as is conventional in known child entertaining products. Of course, any number of mounts 26 and/or toys 24 (including zero) may be used with the walker alternative, if desired. Further, although FIG. 3 illustrates the apparatus 10 without toys, persons of ordinary skill in the art will appreciate that toys are preferably mounted to some or all of the mounts 26 when the apparatus 10 is employed as a floor toy activity center.

Each of the base 12 and the tray 14 is preferably implemented from molded plastic in a conventional fashion. Of course, other materials may alternatively be employed.

In order to support a child in a position that simulates standing, the apparatus 10 is further provided with a seat ring 30. As shown in FIG. 3, the seat ring 30 is positioned within the central aperture 20 of the tray 14. The seat ring 30 is rotatably coupled to the tray 14 such that it can rotate 360°. Preferably, the seat ring 30 is permanently affixed to the tray 14 such that, while the seat ring 14 may be freely rotated relative to the tray 14, it may not be separated therefrom.

Figure 4:
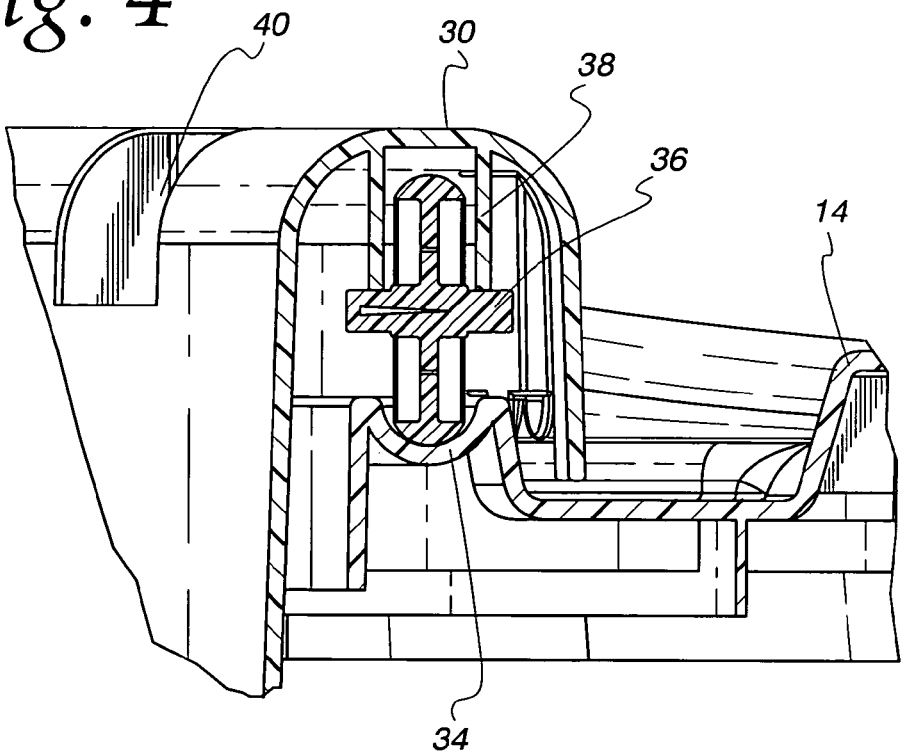
FIG. 4 is a cross-sectional view taken along lines 4-4 of FIG. 1 and illustrating an example manner of rotatably coupling the seat to the base of the apparatus.

An example manner of implementing the rotational connection between the seat ring 30 and the tray 14 is shown in FIG. 4. As shown in FIG. 4, the tray 14 defines a track 34 adjacent its inner perimeter (i.e., adjacent the central aperture 20). A plurality of wheels 36 are positioned within this track 34. The seat ring 30 defines a plurality of upper apertures 38. Each of the upper apertures 38 is positioned to capture the upper half of a corresponding one of the wheels 36. The upper apertures 38 are located directly above the track 34, and are spaced apart from one another in a circle corresponding to the track 34 to ensure the wheels 36 stay within the lower track 34 defined in the tray 14 as the seat ring 30 rotates relative to the tray 14. Although not shown in the drawings, the seat ring 30 preferably includes a plurality of tabs that snap under a ledge of the tray 14. This tab and ledge arrangement permits the seat ring 30 to rotate relative to the tray 14 without permitting separation of the ring 30 from the tray 14.

Like the base 12 and the tray 14, the seat ring 30 and the wheels 36 are preferably implemented from molded plastic. Of course, other materials may alternatively be employed. Additionally, although the illustrated example includes the wheels 36 mentioned above, the wheels can be excluded, if desired, although exclusion of the wheels 36 may result in less free rotation of the seat ring 30.

To support a child within the seat ring 30 and adjacent the tray 14, the apparatus 10 is further provided with a sling or seat 120 (see FIGS. 11-16). The sling or seat 120 may be of any conventional design. For example, it may be a fabric or plastic seat defining two holes 122 sized and positioned to receive respective ones of a child's legs. The seat or sling 120 may be affixed to the seat ring 30 in any conventional fashion. For example, the seat or sling 120 may be coupled to the seat ring 30 using clips that are sewn or otherwise coupled to the seat. As shown in FIG. 4, the illustrated seat ring 30 defines apertures 40 for receiving the clips of a seat or sling 120. Because the seat or sling 120 is positively coupled to the seat ring 30, the seat/sling 120 will rotate with the seat ring 30 and vice versa. Preferably, the seat/sling 120 is coupled to the seat ring 30 such that the seat/sling 120 is positioned at or near the center of the seat ring 30 and at or near the center of the base 12.

The distance that the seat/sling 120 suspends the child above the base 12 is preferably adjustable as shown in FIGS. 11-16. In the example of FIGS. 11-16, the seat/sling 120 is a cloth seat suspended within the seat ring 30 as explained above. The seat/sling 120 defines a pair of holes 122 through which a child's legs extend when supported in the seat/sling 120.

Figure 16:
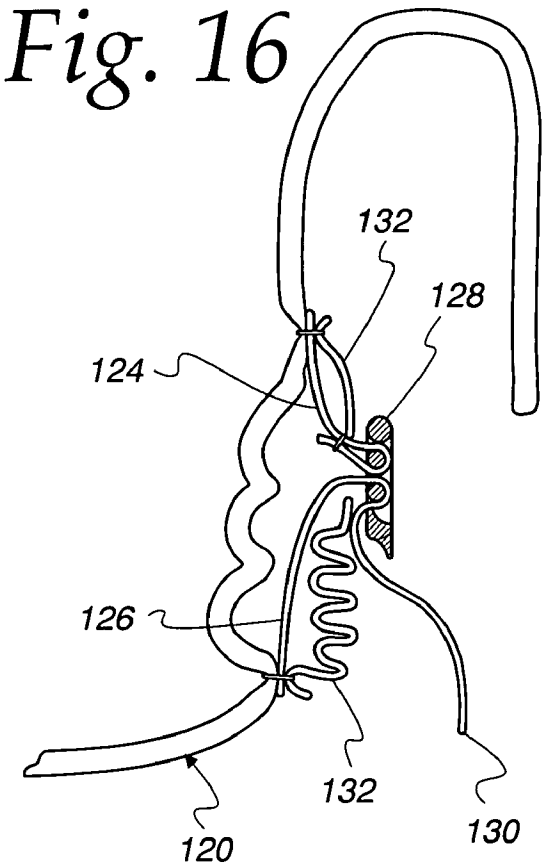
FIG. 16 is a view similar to FIG. 15, but showing the shortening mechanism in an example shortened state.
Figure 15:
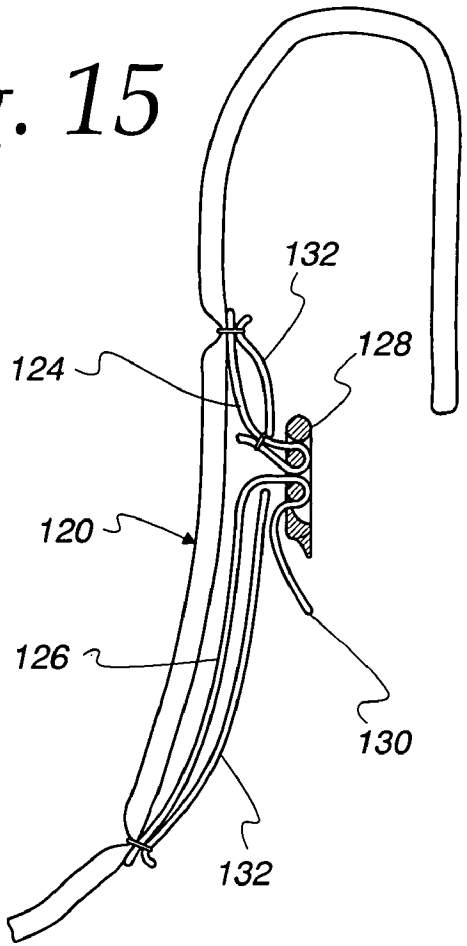
FIG. 15 is a partial cross-sectional view of an example shortening mechanism of the example seat/sling of FIG. 11 showing the shortening mechanism in the fully extended state.

To adjust the distance between the crotch of the seat/sling 120 and the base 12, the seat/sling 120 is provided with a shortening mechanism. In the illustrated example, the shortening mechanism comprises first and second belts 124, 126 and a buckle 128 as shown in FIGS. 15 and 16. The first belt 124 has a first end sewn to the seat/sling 120 and a second end fixedly coupled to the buckle 128. The second belt 126 has a first end sewn to the seat 120. Unlike the first belt 124, the second belt 126 is threaded through the buckle 128 such that a free end 130 of the second belt is slidable relative to the buckle 130. Because the buckle 128 is fixed to the seat 120 by the first belt 124, and because the first end of the second belt 126 is coupled to the seat 120, pulling the second belt 126 through the buckle 128 causes the seat 120 to shorten (compare FIGS. 15 and 16). Thus, by adjusting the position of the second belt 126 relative to the buckle 128, one can adjust the length of the seat 120. Since shortening the seat 120 has the effect of raising the position of the crotch of the seat 120, shortening the seat 120 raises the position of the seat 120 relative to the base 12. Thus, the distance between the bottom of the seat 120 and the base 12 can be continuously adjusted between a fully extended position (see, for example, the position of FIG. 15) and a fully shortened position.

A decorative and/or a protective cover 132 is sewn to the seat/sling 120 as shown in FIGS. 11-16. The cover 132 hides portions of the belts 124, 126 from sight. However, portions of the belts/straps 124, 126 extend through an opening defined in the cover 132 to engage the buckle 128 as explained above.

Although the illustrated example employs the belt/strap 123, 126 and buckle 128 shortening arrangement discussed above, persons of ordinary skill in the art will appreciate that other shortening mechanisms may alternatively be employed. For example, the seat 120 may be shortened using button(s), zipper(s), Velcro, snap(s), or one or more other fastener(s) either directly on the seat or in combination with one or more belts/straps.

For the purpose of removably securing the wheeled walker 16 to the base 12, the base 12 of the illustrated example is provided with a plurality of wheel receptacles 42. In the illustrated example, there is one receptacle 42 for each leg of the wheeled walker 16. However, persons of ordinary skill in the art will readily appreciate that the number of receptacles 42 need not match the number of legs of the wheeled support 16. For example, there may be more or fewer receptacles 42 on the base 12 than there are legs on the wheeled support 16.

Figure 5:
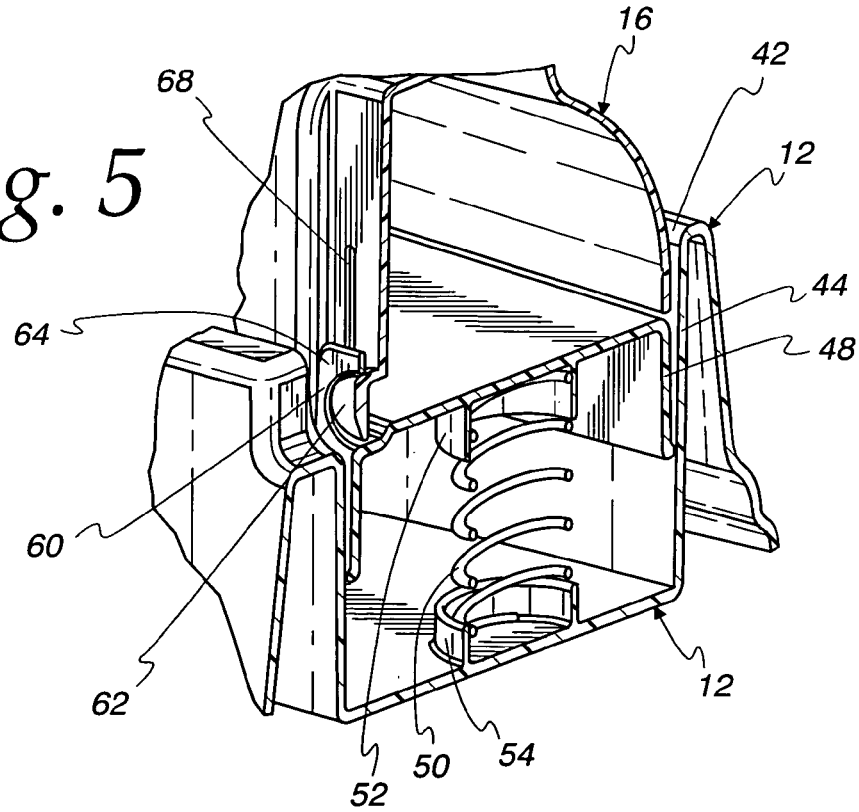
FIG. 5 is a cross-sectional view of a wheel receptacle of the apparatus taken along lines 5-5 of FIG. 1.
Figure 6:
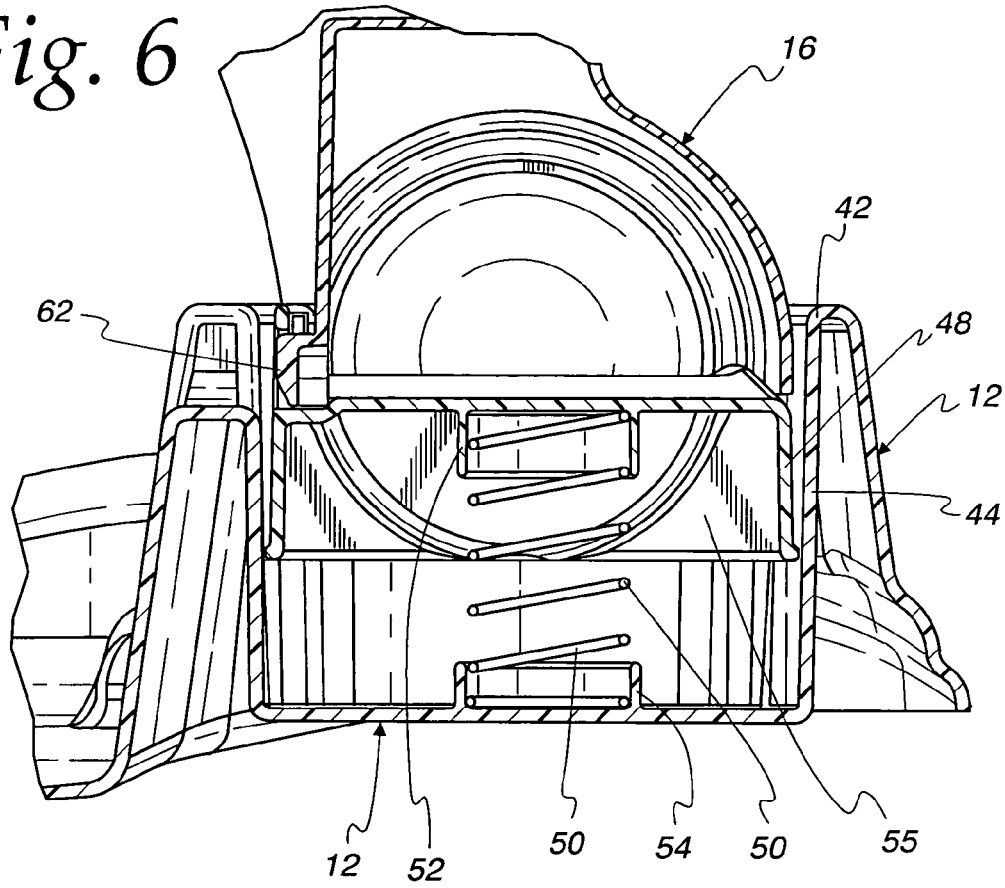
FIG. 6 is a view similar to FIG. 5, but showing a wheel of the wheeled walker located in the wheel receptacle.

In the illustrated example, each of the wheel receptacles 42 includes an upwardly extending wall 44 defining a cavity 46 sized to receive a foot of a corresponding one of the legs of the wheeled walker 16 with sufficiently close tolerance to prevent rolling movement of the wheeled walker 16. To provide bouncing motion when the apparatus 10 is employed as a walker alternative, each receptacle 42 is provided with a spring plate 48 which is suspended above the bottom of the base 12 by one or more coil springs 50. As shown in FIGS. 5 and 6, each coil spring 50 is captured in a loaded condition between a spring seat 52 suspended from the bottom of a spring plate 48 and a spring seat 54 positioned on the base 12. To further ensure the walker 16 is retained against rolling in the receptacles 42, the spring plates 48 may be provided with wheel wells to receive the roller wheels as shown in FIG. 6.

Although the illustrated example depicts the spring 50 as a coil spring, persons of ordinary skill in the art will appreciate that any type of spring or spring material may alternatively be employed to implement the seat spring 32. For example, the spring 50 could be implemented by rubber or another compressible resilient material.

Figure 7:
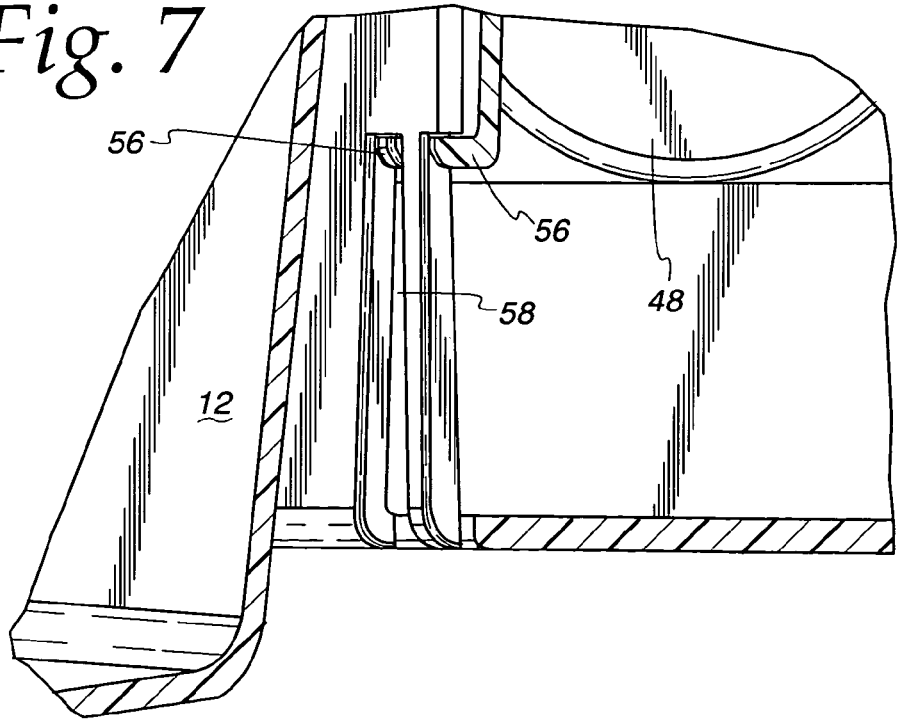
FIG. 7 is an enlarged view of the tabs connecting a spring plate to the base of the apparatus of FIG. 1.

As shown in FIG. 7, each of the spring plates 48 includes a plurality of tabs 56. These tabs 56 are positioned to slide within grooves 58 defined in the base 12 as their corresponding spring plates 48 bounce up and down under the influence of the springs 50. The engagement of the tabs 56 and grooves 58 limits the motion of the spring plates 48 to ensure that the spring plates 48 stay within their corresponding receptacles 42 and that the springs 50 remain in their spring seats 52, 54.

To prevent the legs of the wheeled walker 16 from inadvertently bouncing out of their corresponding receptacles 42, each of the spring plates 48 defines an aperture 60 for removably receiving a tab 62 on the corresponding leg of the wheeled walker 16. As most easily seen in FIG. 5, in the illustrated example, the apertures 60 are defined in extensions 64 that extend upward from the spring plate 48. Because the extensions 64 are coupled to the spring plates 48, when the tabs 62 are disposed in the apertures 60, the wheeled walker 16 is positively secured to the spring plates 48 and, thus, will bounce with the spring plates 48. As mentioned above, the wheeled walker 16 supports the tray 14 above the base 12, and the tray 14 supports the seat/sling via the seat ring 30. Therefore, bouncing movement of the spring plates 48 and/or the walker 16 will result in bouncing of the tray 14, the seat ring 30 and the seat/sling and vice versa.

To remove the wheeled walker 16 from the spring plates 48, the tabs 64 are depressed out of their corresponding apertures 60 and the legs of the walker 16 are lifted out of the receptacles 42. To facilitate depression of the tabs 64, the tabs are mounted adjacent relief cuts 68 formed in the corresponding leg of the wheeled walker 16.

The wheeled walker 16 of the illustrated example is shown in FIG. 2. The example walker 16 of FIG. 2 includes an upper frame 70 and three legs 72 coupled to the upper frame 70. As shown in FIG. 2, the upper frame 70 of the illustrated example is a generally U-shaped frame. A leg 72 extends downward from each end of the U-shaped frame 70. A central leg, which, in this example, is larger than the two rear legs 72, extends downward from the base of the U-shaped frame 70. Each of the legs carries one or more conventional wheels or rollers 76 to permit the wheeled walker 16 to roll along a surface such as a floor of a house when the walker 16 is removed from the base 12 and tray 14. When the walker 16 is positioned on the base 16, the wheels 76 are located in the receptacles 42 such that the springs 50 are located beneath the legs 72 of the walker 16.

Figure 8:
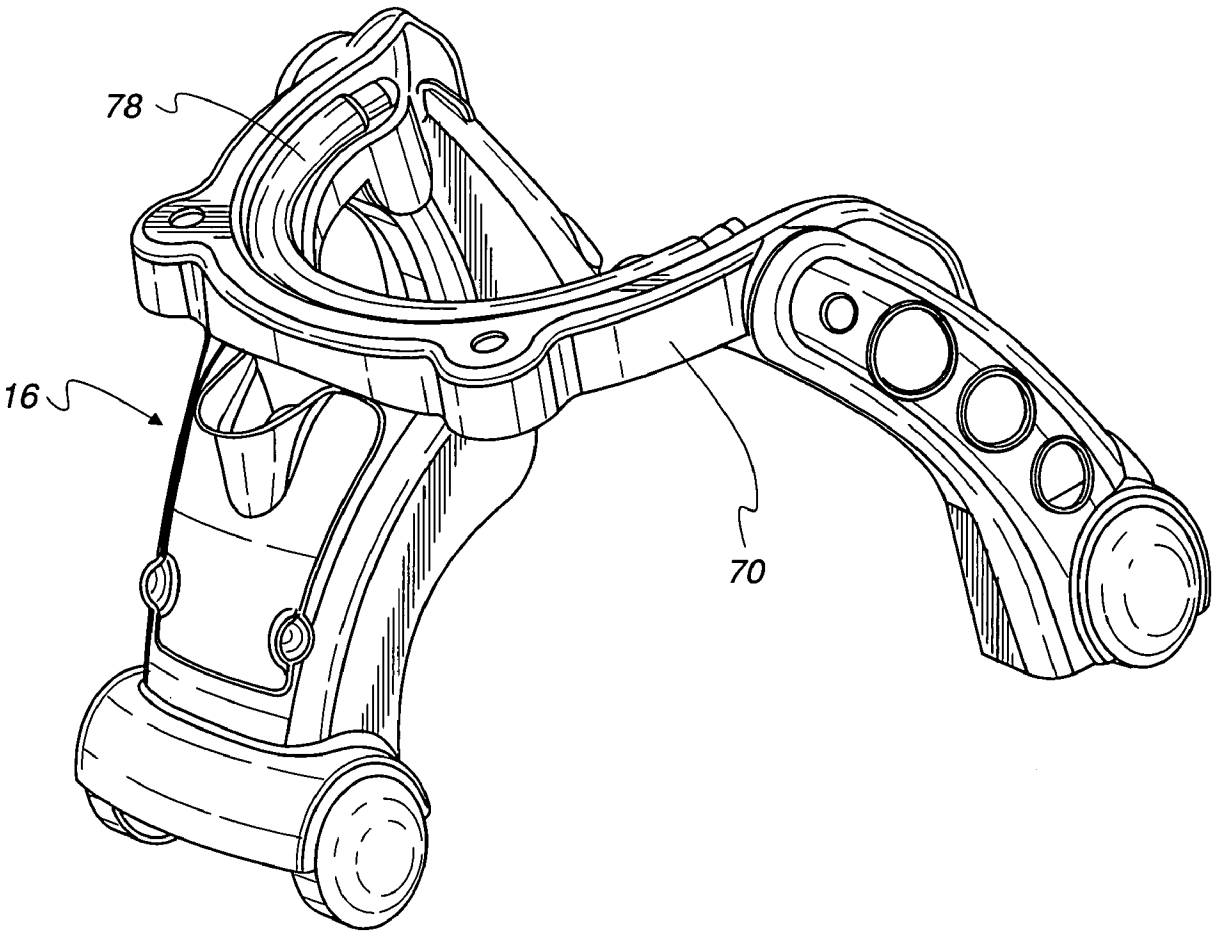
FIG. 8 is a perspective view of the wheeled walker shown with its handle in a stored position.

To facilitate use of the wheeled walker 16 as a walk-behind walker, the wheeled walker 16 is further provided with a handle 78. In the illustrated example, the handle 78 is movable between the use position shown in FIG. 2 and a stored position shown in FIG. 8. In the stored position of FIG. 8, the handle 78 is positioned to lie in a trough defined by the upper frame 70 of the wheeled walker 16 such that it is secured beneath the tray 14 when the apparatus 10 is employed as a walker alternative. In the use position, the ends of the handle 78 are inserted into apertures formed in the upper frame 70 to provide an arch-like gripping surface for a child standing within the U-shaped frame 70 when the apparatus 10 is converted for use as a walk behind walker. The handle 78 is held in the apertures via a snap-in or friction fit. Persons of ordinary skill in the art will appreciate that alternative connection mechanisms may alternatively be employed. For example, the handle 78 may be secured in the apertures via one or more mechanical or chemical fasteners such as screws, rivets, and/or glue. Alternatively, the handle 78 may be a molded detail in the existing part.

As shown in FIG. 2, the wheeled walker 16 may be equipped with toys and/or activities. For instance, some or all of the toys used on the tray 14 may be moved to and mounted on the wheeled walker 16. For example, one or more toys (e.g., the arch toy 200 shown in FIG. 1) may be mounted in holes 202, 204 formed in the top surface of the upper frame 70. Further, in the illustrated example, the rear legs 72 are hollow with upper and lower openings to permit balls to be dropped through the legs. By way of another example, the front leg 72 of the illustrated walker 16 includes a pivotable door 80 with a receptacle 82 to permit the balls to be dropped into a storage area behind the door 78 and to be removed for additional play by pivoting the door open. Of course, the storage area may store other objects besides the balls noted above.

As with the base 12 and the tray 14, the components of the wheeled walker 16 may be manufactured of molded plastic. Of course, other materials may likewise be employed. For example, metal fasteners may be used to join various parts of the apparatus 10 in a conventional manner.

Figure 9:
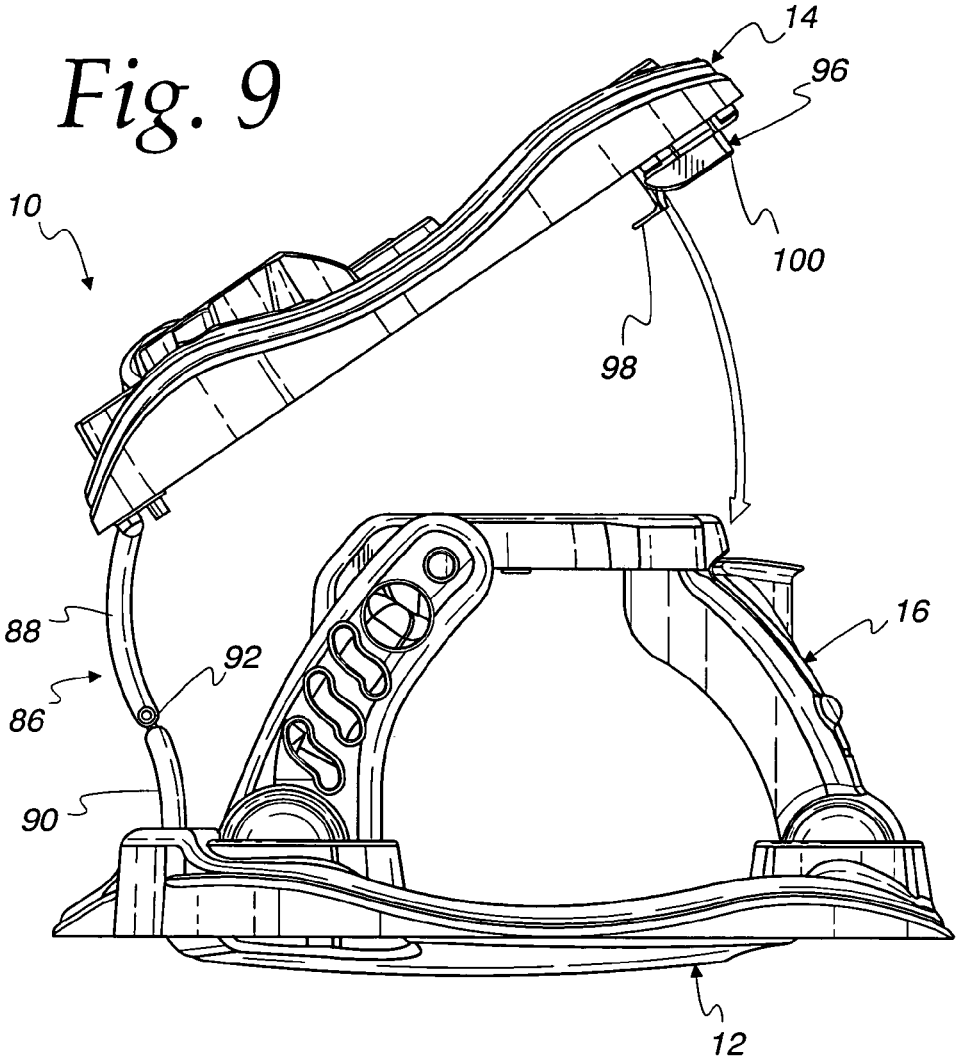
FIG. 9 is a side view of the example apparatus of FIG. 1, showing the tray pivoted relative to the wheeled walker.
Figure 10:
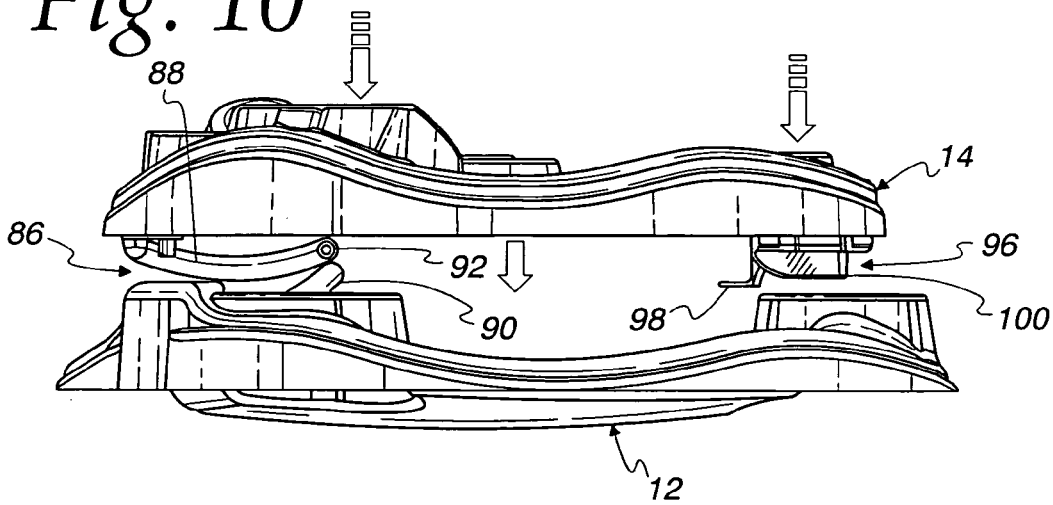
FIG. 10 is a side view of the apparatus showing the apparatus in its collapsed position with its wheeled walker removed.
Figure 11:
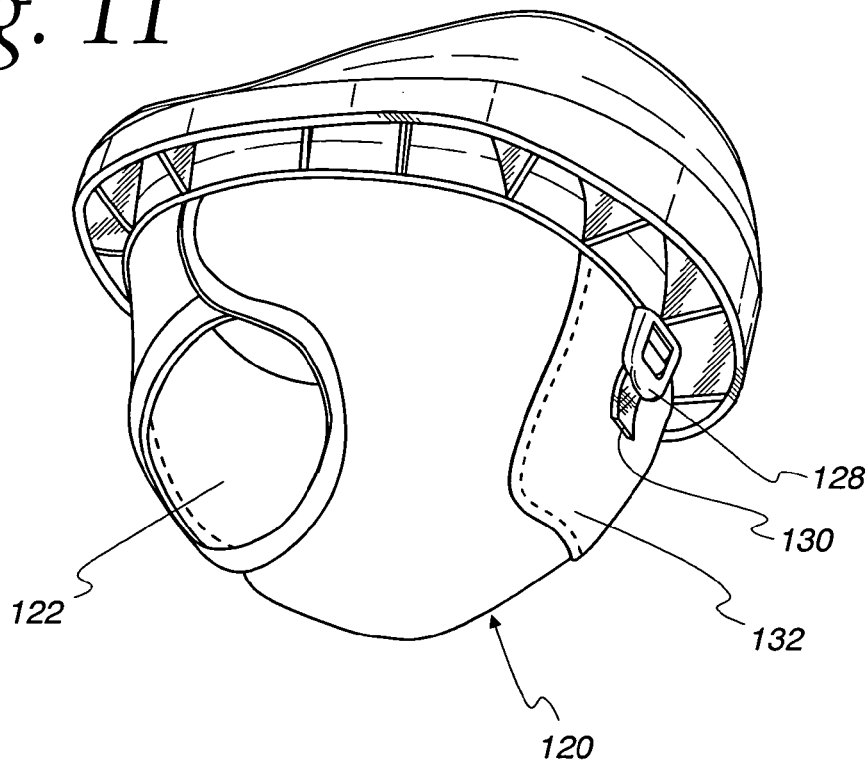
FIG. 11 is a bottom perspective view of an example seat/sling for the apparatus of FIG. 1.
Figure 12:
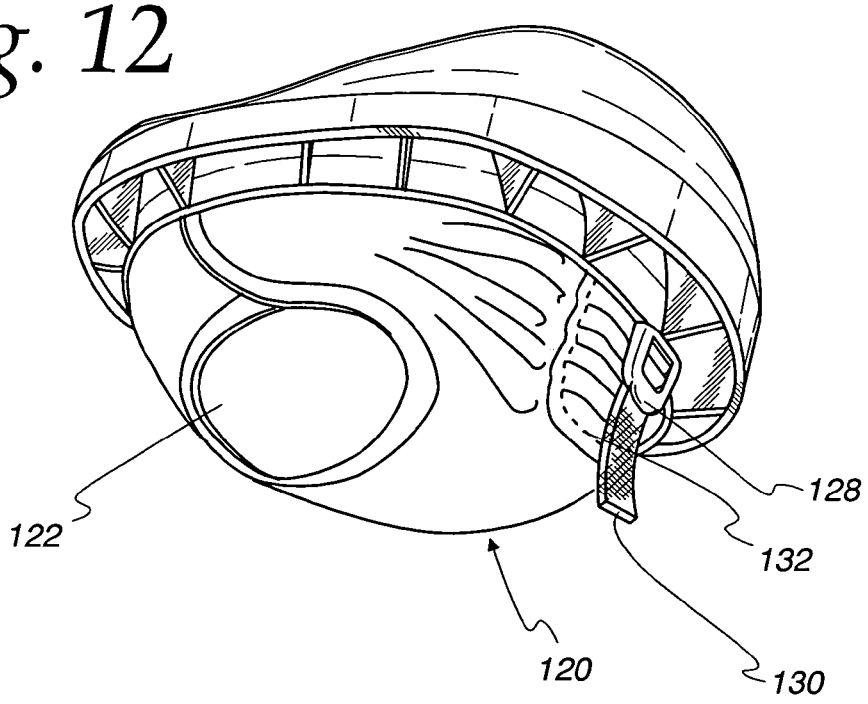
FIG. 12 is a view similar to FIG. 11, but showing the seat/sling in an example shortened state.
Figure 13:
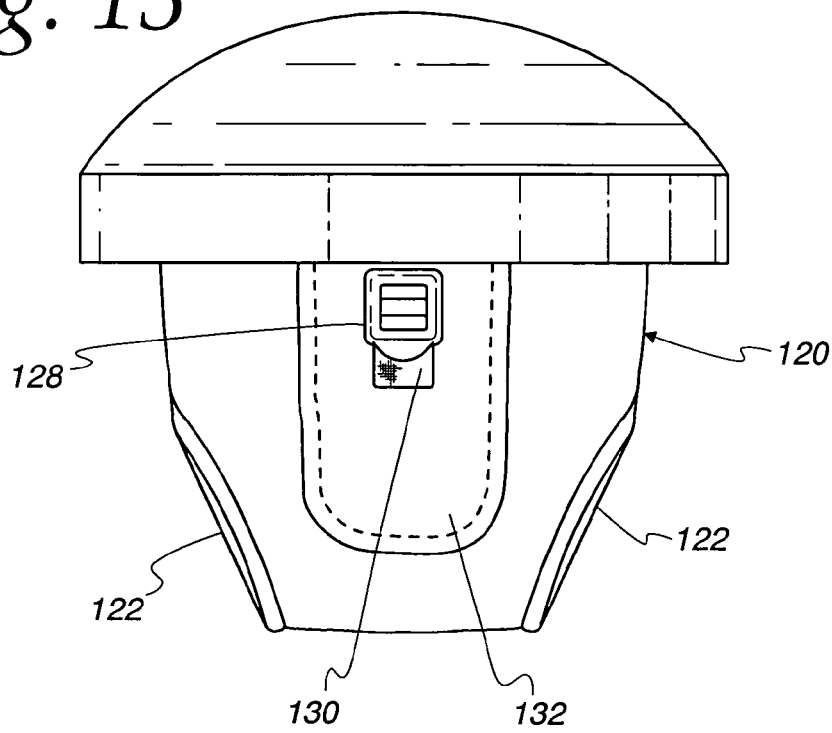
FIG. 13 is a rear view of the seat/sling of FIG. 11 showing the seat/sling in a fully extended state.
Figure 14:
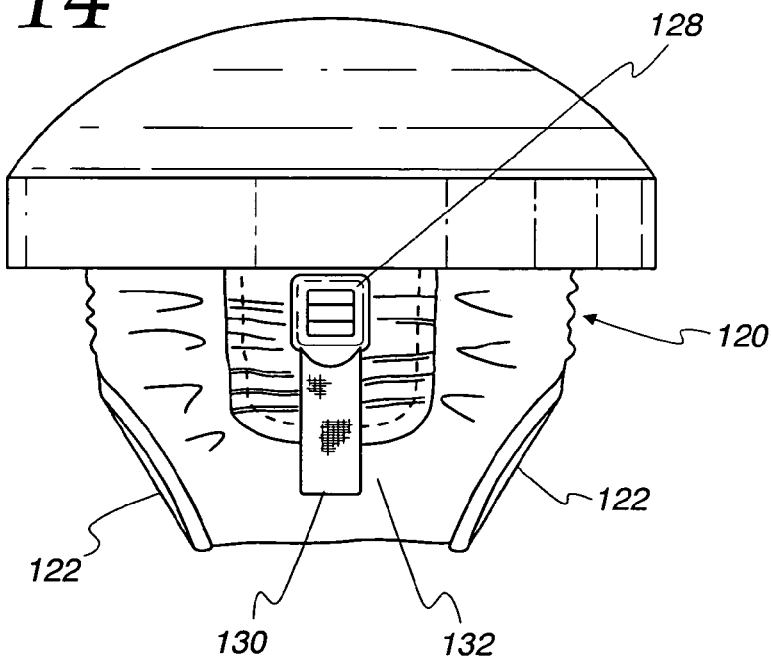
FIG. 14 is a view similar to FIG. 13, but showing the seat in an example shortened state.

In order to ensure that the tray 14 is not used in combination with the wheeled walker 16 apart from the base 12, the tray 14 is coupled to the base 12 by an arm 86. As shown in FIGS. 9 and 10, the arm 86 of the illustrated example has an upper portion 88 and a lower portion 90 which are joined by a hinge 92. The upper portion 88 of the arm 86 is pivotably coupled to the tray 14. The lower portion 90 of the arm 86 is pivotably coupled to the base 12. As a result, when the wheeled walker 16 is removed from the base 12, the tray 14 may be disposed directly above the base 12 as shown in FIGS. 3 and 10. When the tray 14 is so positioned, a child seated on the floor adjacent the base 12 may play with the toys 24 carried by the tray 14 such that the apparatus 10 functions as a floor toy activity center. Therefore, the tray 14 is movable between a first position at a first height above the base 12 and a second position at a second height above the base 12.

Figure 17:
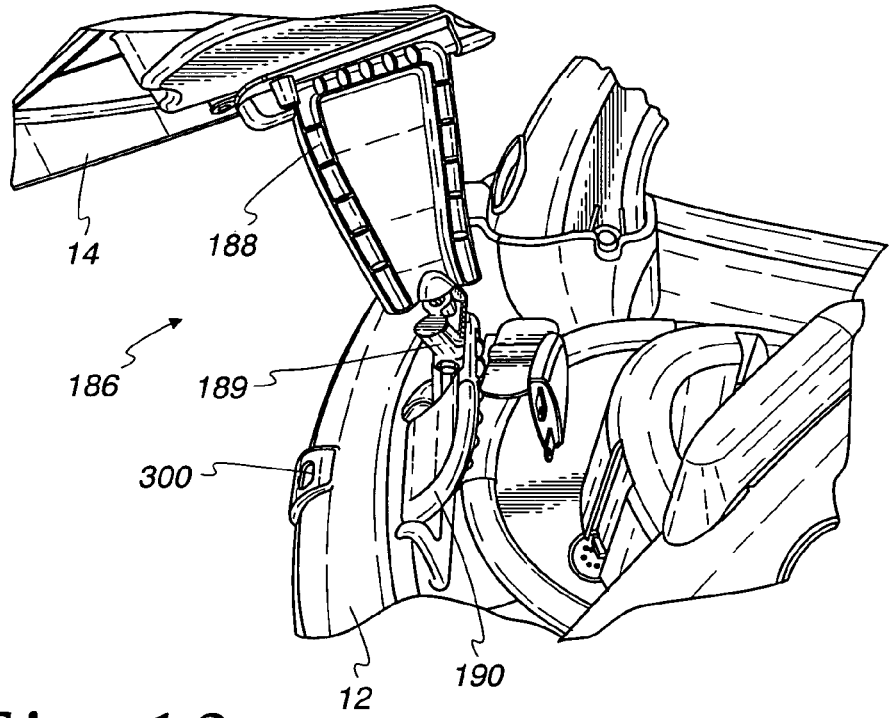
FIG. 17 is a close-up perspective view of the preferred pivoting connection in the arm connecting the tray and the base, and showing the tray pivoted relative to the base.
Figure 18:
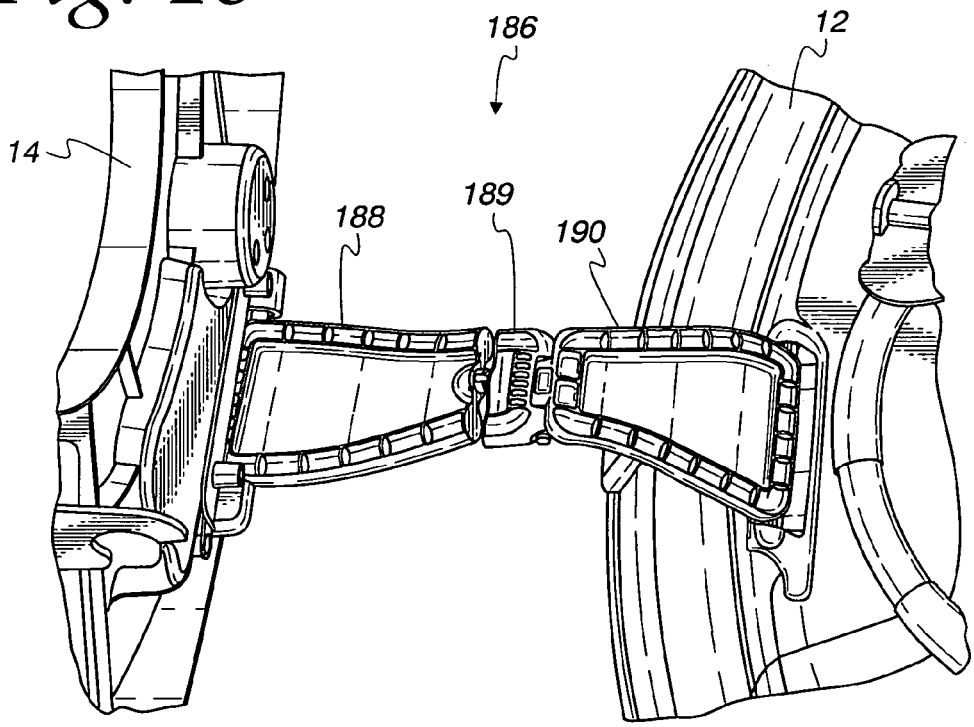
FIG. 18 is a top perspective view of the arm of FIG. 17.

A preferred arm 186 which may be used in place of the arm 86 is shown in FIGS. 17-18. The arm 186 is similar to the arm 86 in that it includes an upper portion 88 which is pivotably coupled to the tray 14 and a lower portion 90 which is pivotably coupled to the base 12. However, the arm 186 also includes an intermediate portion 189. The intermediate portion 189 of the illustrated example is pivotably coupled to the lower portion 190 of the arm for rotation about a first axis and is pivotably coupled to the upper portion 188 for rotation about a second axis which is substantially perpendicular to the first axis. For example, the intermediate portion 189 may be coupled to the upper portion 188 by a pin that acts as an axis of rotation in substantial alignment with the longitudinal axis of the upper portion 188 (See FIG. 17). As a result, when the preferred arm 186 is employed, the motion of the tray 14 relative to the base 12 may have vertical and horizontal components. The arm 186 is preferred relative to the arm 86 because the additional pivoting capability provided by the intermediate portion 189 reduces the likelihood of twisting motion about the longitudinally aligned axes of the upper and lower portions causing a break in the arm 186, since such twisting motion is expressly permitted by the inclusion of the intermediate portion 189.

Although the presently preferred implementation employs an arm 186 to couple the tray 14 and the base 12, persons of ordinary skill in the art will readily appreciate that other connection mechanisms may alternatively be employed. For example, the arm 86, 186 could be replaced with one or more flexible strips of material (e.g., a fabric or vinyl strip).

Moreover, although in the preferred implementation, the tray 14 is permanently coupled to the base 12 and releasably coupled to the wheeled walker 16, persons of ordinary skill in the art will readily appreciate that other approaches may likewise be appropriate. For example, the tray 14 may be permanently secured to the wheeled walker 16 such that the tray 14 is not directly connected to the base 12.

To ensure that the tray 14 is not inadvertently pivoted away from the wheeled walker 16, the apparatus 10 is further provided with a latch 96. The latch 96 may be implemented by any conventional latch. In the illustrated example, the latch 96 is mounted under the tray 14 at a position opposite the location of the arm 86. The illustrated latch 96 includes a projection 98 that may be engaged beneath the upper frame 70 of the wheeled walker 16 to secure the tray 14 to the walker 16. The illustrated latch 96 also includes a handle 100 to facilitate pulling the projection outward from under the U-shaped frame 70 of the walker 16. To prevent the latch 96 from being released inadvertently, the latch 96 may be provided with a spring (not shown) that biases the projection 98 inward toward the wheeled walker 16.

Figure 19:
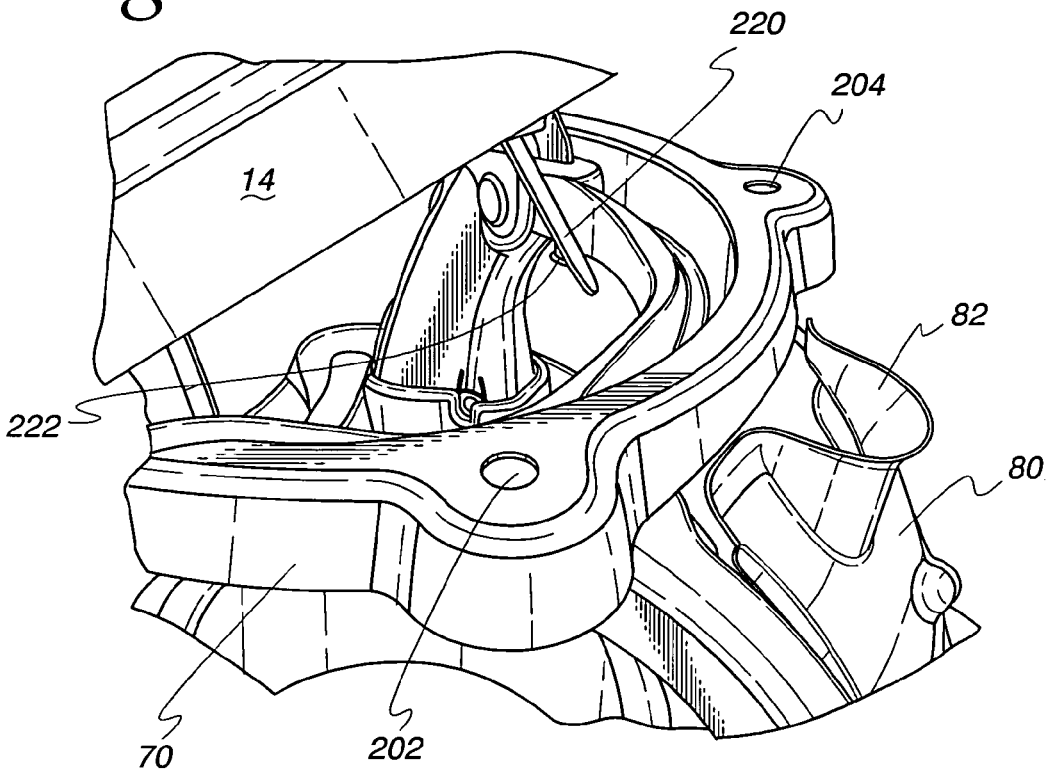
FIG. 19 is a partial perspective view of a preferred latch for securing the tray to the wheeled walker.
Figure 20:
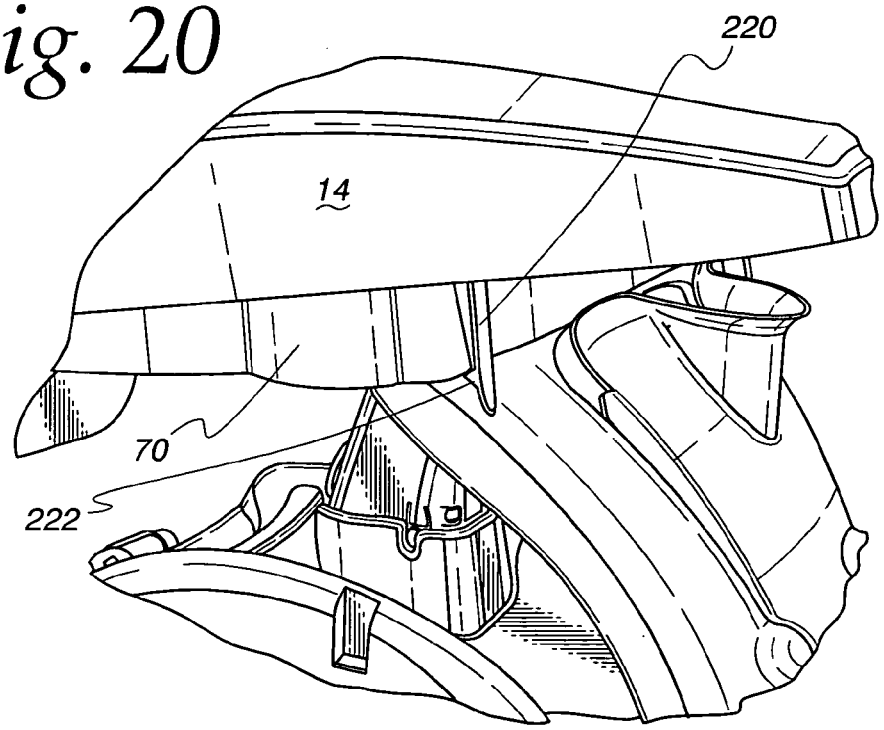
FIG. 20 is a view similar to FIG. 19, but showing the latch in the locked state.

A preferred latch 196 is shown in FIGS. 19 and 20. As shown in FIG. 19, the preferred latch 196 comprises a flexible tab 220 suspended from the tray 14 in a downward orientation. A projection 222 is located on the back of the tab 220. As most easily seen in FIG. 20, the length of the tab 220 and the position of the projection 222 are selected such that, when the tray 14 is positioned on top of the wheeled walker 16, the projection 222 engages under a bottom ledge of the upper support 70 of the wheeled walker 16. This engagement secures the tray 14 to the wheeled walker 16. Because the tab 220 is flexible, the tray 14 can be disengaged from the wheeled walker 16 by simply pulling the bottom end of the tab 220 a sufficient distance outward to permit the projection 222 to clear the bottom ledge of the upper support 70 of the wheeled walker 16 when lifting the tray 14. Persons of ordinary skill in the art will readily appreciate that the latch 196 may be implemented by one or more tabs 220. For example, in the presently preferred implementation, two tabs 220 are employed; with one tab 220 located to engage the front right side of the upper support 70 and the other tab 220 located to engage the front left side of the upper support 70.

Persons of ordinary skill in the art will appreciate that the tab 220 and projection 222 may be implemented in many ways. For example, the tab 220 and projection 222 may be integrally formed of molded plastic.

From the foregoing, persons of ordinary skill in the art will appreciate that the above disclosed apparatus 10 uses a wheeled walker 16 to at least partially support a seat above a base 12 to form a walker alternative. When it is desired to use the apparatus 10 as a wheeled walker 16, the wheeled walker 16 is removed from the base 12 and the tray 14. When the wheeled walker 16 is so removed, the tray 14 may be used as a floor toy activity center.

To assemble the illustrated child entertaining apparatus 10, one places the wheeled walker 16 on the base 12 with the wheels 76 in the receptacles 42 to substantially prevent rolling of the walker 16 relative to the base 12. The walker 16 may be positively latched to the base 12 (e.g., by inserting the tabs 62 into the holes 60). A seat 120 is then positioned above the base 12 (e.g., by pivoting the tray 14 relative to the base 12 and over the walker 16) such that the seat 120 is at least partially supported by the wheeled walker 16. In the illustrated example, the seat 120 is coupled to the tray 14. Therefore, the tray 14 is coupled to the wheeled walker 16 (e.g., by securing the latch or latches 96, 196) to secure the seat to the wheeled walker 16.

To disassemble the illustrated child entertaining apparatus 10, one would release the tray 14 from the wheeled walker 16 (e.g., by releasing the latch or latches 96, 196). The tray 14 and the seat 120 are then removed from the walker 16 (e.g., by pivoting the tray 14 upward relative to the base 12). The positive latches securing the walker 16 to the base 12 are then released (e.g., by depressing the tabs 62), and the wheeled walker 16 is then lifted from the base 12.

If desired, the tray 14 may then be positioned above the base 12 such that the tray 14 may be used as a floor toy activity center.

From the foregoing, persons of ordinary skill in the art will appreciate that the illustrated apparatus 10 is a multi-mode device. In a first mode of operation (see, e.g., FIG. 1), the example apparatus 10 is a walker alternative that may be used to support a child that is not yet able to stand and/or walk on their own in a position that simulates standing. In a second mode of operation (see, e.g., FIG. 2), the apparatus may be used as a walk behind walker 16. In a third mode of operation (see, e.g., FIG. 3), the apparatus 10 may be used as a floor toy activity center.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A child entertaining apparatus comprising:

a base;

a seat; and a wheeled walk-behind walker to at least partially support the seat above the base, the wheeled walk-behind walker being removable from the base and the seat, the wheeled walk-behind walker including at least one wheel in contact with the base when the wheeled walk-behind walker at least partially supports the seat above the base.

2. A child entertaining apparatus as defined in claim 1 wherein the seat is rotatable relative to the base.

3. A child entertaining apparatus as defined in claim 1 wherein the seat comprises a fabric or plastic seat supported within a ring.

4. A child entertaining apparatus as defined in claim 1 wherein the seat is adjustable to adjust a distance between the seat and the base.

5. A child entertaining apparatus as defined in claim 1 wherein the seat includes a shortening mechanism.

6. A child entertaining apparatus as defined in claim 5 wherein the shortening mechanism comprises:

a buckle;

a first belt having a first end fixed to the seat and a second end coupled to the buckle; and a second belt having a first end fixed to the seat and a second end slidable relative to the buckle.

7. A child entertaining apparatus as defined in claim 1 further comprising a tray.

8. A child entertaining apparatus as defined in claim 7 wherein the tray is at least partially supported by the wheeled walk-behind walker.

9. A child entertaining apparatus as defined in claim 8 wherein the tray is removably secured to the wheeled walk-behind walker.

10. A child entertaining apparatus as defined in claim 7 wherein the seat is suspended adjacent the tray.

11. A child entertaining apparatus as defined in claim 7 further comprising at least one toy coupled to the tray.

12. A child entertaining apparatus as defined in claim 11 wherein when the wheeled walk-behind walker is removed from the base, the tray is disposed above the base to permit a child seated on the floor to play with the at least one toy.

13. A child entertaining apparatus as defined in claim 7 wherein the tray is coupled to the base by an arm.

14. A child entertaining apparatus as defined in claim 13 wherein the tray is pivotably coupled to the arm.

15. A child entertaining apparatus as defined in claim 13 wherein the arm has an upper portion and a lower portion, at least one of the upper and lower portions being rotatable relative to another of the upper and lower portions.

16. A child entertaining apparatus as defined in claim 15 wherein the at least one of the upper and lower portions is rotatable about a longitudinal axis of the arm.

17. A child entertaining apparatus as defined in claim 1 further comprising springs to permit bouncing movement between the seat and the base.

18. A child entertaining apparatus as defined in claim 1 wherein the base comprises a domed surface beneath the seat.

19. A child entertaining apparatus as defined in claim 1 wherein the base is rockable.

20. A child entertaining apparatus as defined in claim 19 further comprising a lock out mechanism to selectively substantially prevent rocking of the base.

21. A child entertaining apparatus as defined in claim 20 wherein the lock out mechanism includes a leg canying a state message and the base defines a window positioned to display the state message when the lock out mechanism is in a predetermined state associated with the state message.

22. A child entertaining apparatus as defined in claim 1 wherein the wheeled walker comprises at least one leg.

23. A child entertaining apparatus as defined in claim 22 wherein the wheeled walker further comprises an upper frame coupled to the at least one leg.

24. A child entertaining apparatus as defined in claim 22 wherein the wheeled walker further comprises a handle located to be gripped by a standing child.

25. A child entertaining apparatus as defined in claim 24 wherein the handle is movable relative to the tray from a stored position to a use position.

26. A child entertaining apparatus comprising:

a base;

a seat; and a wheeled walker to at least partially support the seat above the base, the wheeled walker being removable from the base, the wheeled walker including at least one wheel in contact with the base when the wheeled walker at least partially supports the seat above the base, wherein a tray is coupled to the base by an arm, the arm has an upper portion and a lower portion, the upper and lower portions being joined by at least one hinge.

27. A child entertaining apparatus as defined in claim 26 wherein the hinge is rotatably coupled to at least one of the upper and lower portions to permit rotation of at least one of the upper and lower portions about a longitudinal axis of the arm.

28. A child entertaining apparatus as defined in claim 26 wherein the upper portion of the arm is pivotably coupled to the tray and the lower portion of the arm is pivotably coupled to the base.

29. A child entertaining apparatus comprising:

a base;

a seat;

a wheeled walker to at least partially support the seat above the base, the wheeled walker being removable from the base, the wheeled walker including at least one wheel in contact with the base when the wheeled walker at least partially supports the seat above the base; and springs to permit bouncing movement between the seat and the base, wherein the wheeled walker includes legs with wheels, the base includes receptacles for receiving the wheels of the wheeled walker, and the springs are located at least partially beneath the legs when the wheels are received in the receptacles.

30. A child entertaining apparatus comprising a base;

a seat; and a wheeled walker to at least partially support the seat above the base, the wheeled walker being removable from the base, wherein the wheeled walker includes wheels and the base includes receptacles for receiving the wheels of the wheeled walker; and springs located at least partially beneath the wheels when the wheels are received in the receptacles to permit bouncing movement between the seat and the base.

* * * * *